US007731378B2

(12) United States Patent
Dutcher

(10) Patent No.: US 7,731,378 B2
(45) Date of Patent: Jun. 8, 2010

(54) LIGHTED HAIR ACCESSORY

(76) Inventor: Andrew T. Dutcher, 2401 Sanford Dr., Columbus, OH (US) 43235

( * ) Notice: Subject to any disclaimer, the term of this patent is extended or adjusted under 35 U.S.C. 154(b) by 0 days.

(21) Appl. No.: 12/261,140

(22) Filed: Oct. 30, 2008

(65) Prior Publication Data

US 2009/0109660 A1 Apr. 30, 2009

Related U.S. Application Data

(60) Provisional application No. 61/001,128, filed on Oct. 31, 2007.

(51) Int. Cl.
*F21V 21/08* (2006.01)

(52) U.S. Cl. ..... 362/103; 362/105; 362/800; 132/273; 63/1.11; 63/43; 2/906

(58) Field of Classification Search ..... 362/103–105, 362/800, 570, 571; 2/906; 63/1.11, 43; 132/275, 132/278, 273; D28/41
See application file for complete search history.

(56) References Cited

U.S. PATENT DOCUMENTS 5,934,784 A * 8/1999 Dion ..... 362/103
7,131,743 B2 * 11/2006 Leason et al. ..... 362/104
2004/0007243 A1 * 1/2004 Paterson ..... 132/275

* cited by examiner

*Primary Examiner*—Stephen F Husar
(74) *Attorney, Agent, or Firm*—Mueller Smith & Okuley, LLC

(57) ABSTRACT

A lighted hair accessory includes a power source; one or more light emitting devices in electrical connection with the power source; and a switch interposed between the power source and the light emitting devices. A hair accessory configured to secure a bunch of hair is fitted with the power source, light emitting devices, and switch for the hair accessory to selectively display light by activating the switch.

13 Claims, 2 Drawing Sheets

LIGHTED HAIR ACCESSORY

CROSS-REFERENCE TO RELATED APPLICATIONS

This applications claims benefit of priority on provisional application Ser. No. 61/001,128, filed on Oct. 31, 2007, the disclosure of which is expressly incorporated herein by reference.

STATEMENT REGARDING FEDERALLY SPONSORED RESEARCH

Not applicable.

BACKGROUND

The present disclosure relates generally to women's hair accessories and more particularly to hair accessories having a light source.

Typical of such hair accessories are scrunchies, barrettes, ponytail holders, bobby pins, clam clips, hair bands, hair bows, combs, ribbons, and the like. These hair accessories are configured to secure a defined amount or bunch of hair. While such hair accessories are functional in that they confine hair to keep it out of the face or in a particularly defined hairstyle, they also have become part of the wearer's ensemble. Thus, hair accessories are often matched in color and style with the outfit worn by the user.

The disclosure adds yet another flair to such hair accessories.

BRIEF SUMMARY

The disclosure is directed to hair accessories, such as scrunchies, barrettes, ponytail holders, bobby pins, clam clips, hair bands, hair bows, combs, ribbons, and the like, incorporating a light source and a power supply. When the light source is energized by the power supply, the light source will emit light to give the hair accessory a unique appearance. The light source may be one or more conventional light emitting devices and may comprise a single light emitting device of a particular color, a single light emitting device that changes colors, a plurality of light emitting devices each of a particular color, a plurality of light emitting devices each of a different color, and so forth. Because of the relatively small size of most hair accessories, a light source having a generally low power requirement may be employed. For example, the light source may be one or more light emitting diodes (LEDs), grain of wheat bulbs, Christmas bulbs, or the like. A control circuit may be provided to control the supply of power to the light source to generate different light effects. For example, the light source may continuously emit light or blink intermittently. If the light source comprises more than one light-emitting device, then the control circuit may be programmed to cause the light emitting devices to emit light in a predetermined or random pattern.

A lighted hair accessory, then, includes a power source; one or more light emitting devices in electrical connection with the power source; and a switch interposed between the power source and the light emitting devices. A hair accessory configured to secure a bunch of hair is fitted with the power source, light emitting devices, and switch for the hair accessory to selectively display light by activating the switch.

BRIEF DESCRIPTION OF THE DRAWINGS

For a fuller understanding of the nature and advantages of the present device, reference should be had to the following detailed description taken in connection with the accompanying drawings, in which.

DETAILED DESCRIPTION

Figure 1:
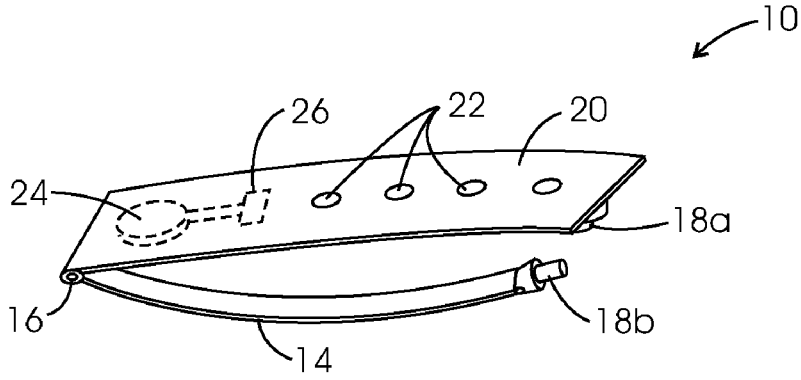
FIG. 1 illustrates an embodiment of the lighted hair accessory in the form of a barrette adapted to be placed about a defined amount of hair.

FIG. 1 shows one embodiment of the disclosed lighted hair accessory in which the hair accessory is a barrette. A barrette, 10, is seen to include, in conventional fashion, an upper section, 12, and a lower section, 14, which sections are connected by a hinge, 16. All or a portion of the user's hair is positioned between upper barrette section 12 and lower barrette section 14 and then secured together by a clasp assembly, 18, which typically is formed with a portion, 18*a*, affixed to upper section 12 and a mating portion, 18*b*, affixed to lower portion 14. Together, mating clasp portions 18*a* and 18*b* form clasp assembly 18.

Upper section 12 has a generally rectangular shape, but the skilled artisan will appreciate that the upper section may be formed in any of a variety of shapes including, for example, circular, oval, square, or the like. Associated with the outer surface of upper section 12 is a small circuit board assembly, 20, with a light source in the form of four (4) surface mounted LEDs, 22. Circuit board assembly 20 is connected to a power supply, which in this embodiment is a small 1.4 Volt zinc air battery, 24, of the type used in hearing aids. Alternatively, the power supply may be a conventional lithium or silver oxide watch battery of, for example, 1.35 or 1.55 volts, or a rechargeable battery, for example. Other power sources, including, for example, a solar panel, rechargeable battery, fuel cell, or the like, can be used in place of the illustrated battery. Finally, circuit board assembly 20 contains a pressure switch, 26, operable by the user and which completes the circuit of battery 24 with LEDs 22. Switch 26 can be a one-time or a multi-time use switch.

Before or once barrette 10 is placed in the hair of the user, switch 26 is activated to directly power to LED lights 22, so that they may blink to whatever configuration assigned to them by the electronic circuitry. Light color and the LED pattern may vary according to the motif or event that the product may represent, i.e. holidays, school colors and logo, professional sports team colors and logo, etc.

Figure 2:
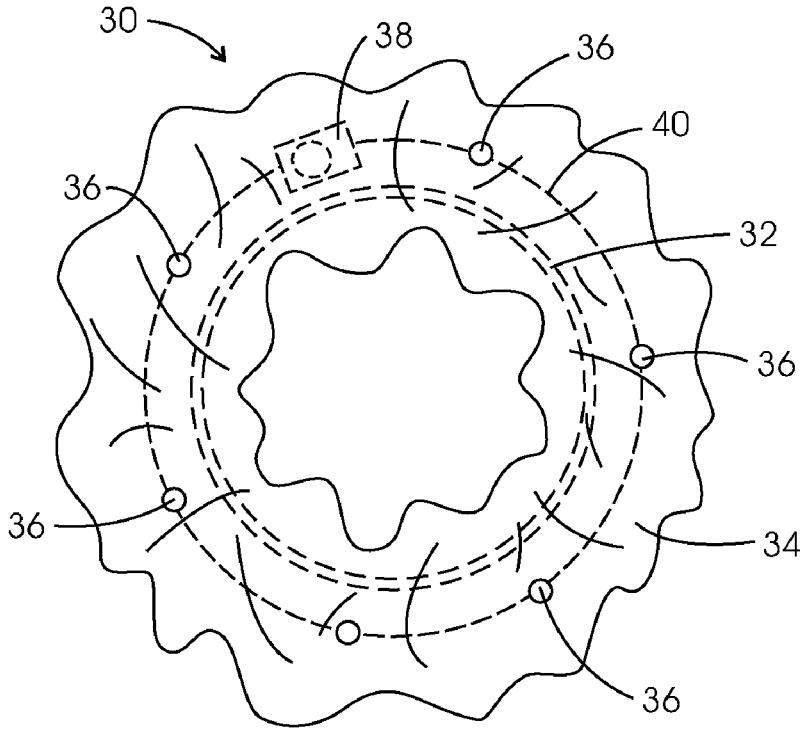
FIG. 2 illustrates an embodiment of the lighted hair accessory in the firm of a pony tail holder or so-called scrunchie" for securing a pony tail of hair.

FIG. 2 illustrates another embodiment of the disclosed lighted hair accessory wherein the hair accessory is a scrunchie, 30, which conventionally includes a ponytail-type elastic band, 32, covered with fabric or cloth, 34. As is seen in this figure, the light source includes seven (7) LED lights, 36, in electrical connection with a control circuit board, 38, which may include a microprocessor, and a power source, 38, which conveniently due to size is a hearing aid-type battery. The number and positioning of the LEDs is intended to be illustrative and not limiting of the present disclosed lighted hair accessory. Led lights 36 are connected by flexible conduit-like traditional low voltage wire, 40. These lights could be wired in a closed circuit so that they all flash in unison or they could be wired to flash in pre-designated patterns. The scrunchie fabric may be printed with alphanumeric characters and/or graphics, including sports logos and team names for high school, college, and professional teams. Holiday themes also may be presented by incorporating appropriate fabric and/or LED color schemes along with traditional representations of holiday symbols.

In the embodiments disclosed in FIGS. 1 and 2, the power supply is attached to the hair accessory. Alternatively, the power supply or additional power may be supplied by a remotely located power supply electrically connected to the circuit board. For example, a remotely located power supply in the form of AA or AAA battery(ies) may be secured in a section of hair adjacent the hair accessory. The remote power supply also may be secured to the clothing of the user. It also is possible to provide an access opening, for example, in fabric 34 to replace worn out or exhausted batteries. Such closure could be fitted with a zipper, snaps, buttons, or like closure for the user to access the batteries for their replacement.

Figure 3:
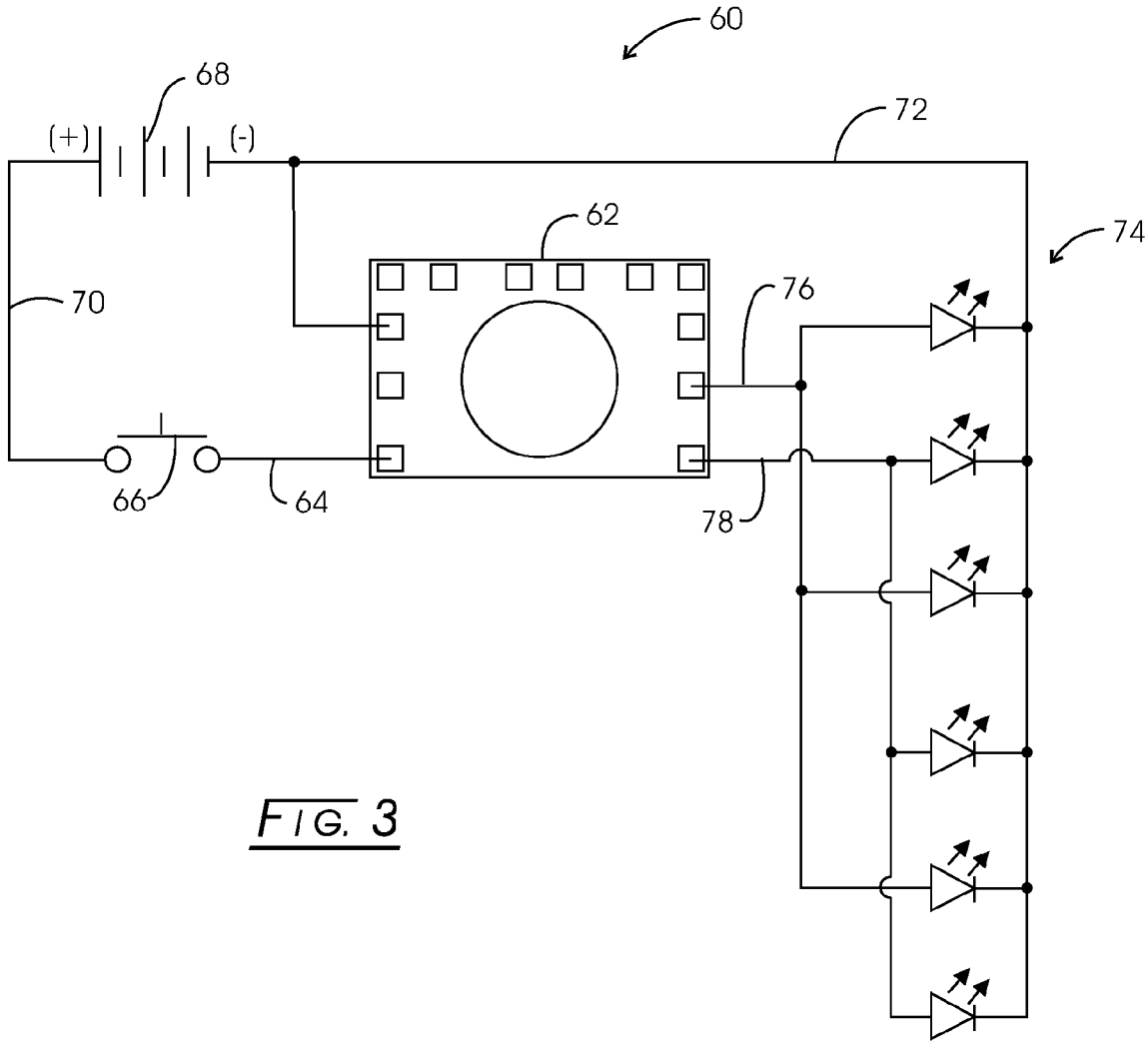
FIG. 3 is an exemplary circuit for lighting a hair accessory disclosed herein. The drawings will be described in detail below.

A representative light emitting assembly, 60, suitable for use with scrunchie or ponytail holder 30 is illustrated in FIG. 3. More particularly, a processor, 62, (for example model FR670 manufactured by Great Wall Technology, Taiwan) has an output lead, 64, to a push-button switch assembly, 66, in electrical connection with a battery pack, 68, via an electrical lead, 70. A lead, 72 exits battery pack 68 and connects to another lead, 74, to supply power to processor 62. Lead 72 also is in electrical connection with an LED rope display assembly, 74, that includes 6 LEDs. LED rope display assembly 74, then, is connected back to processor 62 via leads 76 and 78.

Like before, battery pack 68 suitably accommodates 2 or 3 watch or hearing aid sized/type batteries for energization of LED rope display assembly 74 and processor 62. Processor 62 can be pre-programmed for the LED lights to blink in unison, sequentially, or in a wide variety of patterns. A different number of LED lights also can be used, as is necessary, desirable, or convenient. Similarly, switch 66 could be a motion-activated switch, e.g., mercury switch, or any number of other switches for achieving special affects.

While the lighted hair accessory has been described in connection with use as a hair accessory, it also could be adapted as a collar for a pet, such as, for example, a dog or a cat. Moreover, the disclosed lighted accessory could be used as a safety device. An example of such safety use would be for children to wear the lighted accessory in their hair, as a wristband, or affixed to their clothing to illuminate the children during trick-or-treating activities in celebration of Halloween. For that matter, adult walkers, joggers, bicycle riders, and the like, could use the disclosed illumination device in alert oncoming traffic of their presence during low light conditions, e.g., at dawn, dusk, or nighttime hours.

It is entirely possible to replace the light string with a plastic member containing glow fluid or a fiber optic cable to carry light from a single light source. It might even be possible to place a small receiver inside the hair accessory to receive radio signals, such as, for example, music; or to dispose an MP3 or similar player inside the accessory to provide light and music.

While the apparatus has been described with reference to various embodiments, those skilled in the art will understand that various changes may be made and equivalents may be substituted for elements thereof without departing from the scope and essence of the disclosure. Additionally, many modifications may be made to adapt a particular situation or material to the teachings of the disclosure without departing from the essential scope thereof. Therefore, it is intended that the disclosure may not be limited to the particular embodiments disclosed, but that the disclosure will include all embodiments falling within the scope of the appended claims. In this application the US measurement system is used, unless otherwise expressly indicated. Also, all citations referred to herein are expressly incorporated herein by reference.

I claim:

1. A lighted hair accessory, which comprises:

a hair scrunchie comprising an elastic band covered with fabric and configured to secure a bunch of hair and inside of said fabric is disposed a light emitting assembly comprising:

(a) a power source;

(b) one or more light emitting devices in electrical connection with said power source;

(c) a switch interposed between said power source and said light emitting devices and activatable by a user;

wherein said hair accessory selectively displays light by activating said switch.

2. The lighted hair accessory of claim 1, wherein said light emitting devices are light emitted diodes.

3. The lighted hair accessory of claim 1, wherein said power source is a battery.

4. The lighted hair accessory of claim 1, wherein said hair scrunchie has an aperture for accessing said power source for its replacement.

5. The lighted hair accessory of claim 4, wherein said aperture is selectively closable and openable.

6. The lighted hair accessory of claim 1, wherein a circuit board assembly is connected to said battery.

7. The lighted hair accessory of claim 6, wherein said circuit board assembly controls the illumination of said light devices in a predetermined pattern or a random pattern.

8. The lighted hair accessory of claim 1, wherein said light devices emit colored light.

9. A lighted hair accessory, which comprises:

a hair scrunchie comprising an elastic band covered with fabric and configured to secure a bunch of hair and inside of said fabric is disposed a light emitting assembly comprising:

(a) a battery power source;

(b) one or more light emitting diodes in electrical connection with said battery power source;

(c) a switch interposed between said power source and said light emitting devices and operable by a user; and (d) a circuit board assembly disposed between said battery power source and said light emitting diodes, wherein said hair accessory selectively displays light by activating said switch.

10. The lighted hair accessory of claim 9, wherein said hair scrunchie has an aperture for accessing said battery power source for its replacement.

11. The lighted hair accessory of claim 10, wherein said aperture is selectively closable and openable.

12. The lighted hair accessory of claim 9, wherein said circuit board assembly controls the illumination of said light devices in a predetermined pattern or a random pattern.

13. The lighted hair accessory of claim 9, wherein said light emitting diodes emit colored light.

* * * * *